US010353331B2

(12) United States Patent
Takagami et al.

(10) Patent No.: US 10,353,331 B2
(45) Date of Patent: Jul. 16, 2019

(54) IMAGE FORMING APPARATUS WITH PROCESS CONTROLLER THAT DETERMINES WHETHER TO RE-EXECUTE A REFRESH PROCESS FOR CHARGING A SURFACE OF A PHOTOCONDUCTOR TO PREVENT IMAGE DELETION

(71) Applicant: KYOCERA Document Solutions Inc., Osaka-shi (JP)

(72) Inventors: Ai Takagami, Osaka (JP); Satoshi Sunayama, Osaka (JP)

(73) Assignee: KYOCERA Document Solutions Inc. (JP)

( * ) Notice: Subject to any disclaimer, the term of this patent is extended or adjusted under 35 U.S.C. 154(b) by 0 days.

(21) Appl. No.: 16/199,478

(22) Filed: Nov. 26, 2018

(65) Prior Publication Data

US 2019/0163107 A1 May 30, 2019

(30) Foreign Application Priority Data

Nov. 29, 2017 (JP) ..... 2017-228974

(51) Int. Cl.
*G03G 21/00* (2006.01)
*G03G 15/00* (2006.01)
*G03G 15/02* (2006.01)

(52) U.S. Cl.
CPC ..... *G03G 15/5037* (2013.01); *G03G 15/0225* (2013.01); *G03G 15/0266* (2013.01); *G03G 21/0011* (2013.01); *G03G 21/0058* (2013.01); *G03G 21/0094* (2013.01); *G03G 15/0233* (2013.01)

(58) Field of Classification Search
CPC ..... G03G 15/0225; G03G 15/0233; G03G 15/0266; G03G 15/5037; G03G 21/0011; G03G 21/0058; G03G 21/0094
See application file for complete search history.

(56) References Cited

U.S. PATENT DOCUMENTS

2015/0063837 A1* 3/2015 Tsujita ..... 399/26
2017/0285509 A1* 10/2017 Takagami ..... G03G 15/0266

FOREIGN PATENT DOCUMENTS

JP 2004-347662 12/2004

* cited by examiner

*Primary Examiner* — Sophia S Chen
(74) *Attorney, Agent, or Firm* — Gerald E. Hespos; Michael J. Porco; Matthew T. Hespos

(57) ABSTRACT

An image forming apparatus includes a photoconductor, a charging member, a voltage applier, a rubbing member, a process executor, a current detector, a characteristic deriver and a process controller. The rubbing member is arranged in contact with a surface of the photoconductor to rub the surface. The process executor executes a refresh process of causing the rubbing member to rub the surface for a predetermined time by supplying toner to the rubbing member. The current detector detects a current value of a current flowing from the charging member to the photoconductor. The characteristic deriver derives an electrical characteristic of discharge products adhering to the surface on the basis of an oscillating voltage applied to the charging member by the voltage applier and the current value. The process controller determines whether or not to re-execute the refresh process according to the electrical characteristic when the refresh process is finished.

6 Claims, 8 Drawing Sheets

IMAGE FORMING APPARATUS WITH PROCESS CONTROLLER THAT DETERMINES WHETHER TO RE-EXECUTE A REFRESH PROCESS FOR CHARGING A SURFACE OF A PHOTOCONDUCTOR TO PREVENT IMAGE DELETION

INCORPORATION BY REFERENCE

This application is based on Japanese Patent Application No. 2017-228974 filed with the Japan Patent Office on Nov. 29, 2017, the contents of which are hereby incorporated by reference.

BACKGROUND

The present disclosure relates to an image forming apparatus for charging a surface of a photoconductor.

Conventionally, a photoconductor including a photoconductive layer having a thickness of ten to several tens of μm and forming a surface for carrying electrostatic latent images is used in an image forming apparatus such as a printer or a copier. In an image forming apparatus using such the photoconductor, a phenomenon called image deletion may occur. The image deletion is a phenomenon in which an image is blurred or the periphery of an image is bled.

The image deletion occurs due to a reduction of surface resistance of the surface of the photoconductor. Specifically, by discharge from a conductive member, discharge products such as nitrate ions and ammonium ions adhere to the surface of the photoconductor. If these discharge products absorb moisture in the air to be ionized, the surface resistance of the photoconductor decreases. Electrostatic latent images formed on the surface of the photoconductor having a reduced surface resistance flows to the periphery to induce a potential drop. In this way, boundaries of the electrostatic latent images become unclear, resulting in the image deletion.

To suppress the occurrence of this image deletion, it is known to arrange a cleaning roller (rubbing roller) for rubbing the surface of the photoconductor in contact with the surface of the photoconductor and perform a refresh process such as when a power supply is turned on in a high-humidity environment. The refresh process is a process of causing the cleaning roller to rub the surface of the photoconductor for a given time by supplying a predetermined amount of toner to the cleaning roller while rotating the cleaning roller at a rotation speed faster than that of the photoconductor. In this way, discharge products adhering to the surface of the photoconductor are known to be actively removed. A timing of performing the refresh process is uniquely determined by humidity around the photoconductor. Further, it is known to change a supply amount of the toner during the refresh process according to temperature and humidity air environments around the photoconductor.

SUMMARY

An image forming apparatus according to the present disclosure includes a photoconductor, a charging member, a voltage applier, a rubbing member, a process executor, a current detector, a characteristic deriver and a process controller. The photoconductor includes a photoconductive layer forming a surface for carrying an electrostatic latent image. The charging member is arranged in contact with or in proximity to the surface. The voltage applier charges the surface by applying an oscillating voltage obtained by superimposing a direct-current voltage and an alternating-current voltage to the charging member. The rubbing member is arranged in contact with the surface to rub the surface. The process executor executes a refresh process of causing the rubbing member to rub the surface for a predetermined time by supplying toner to the rubbing member. The current detector detects a current value of a current flowing from the charging member to the photoconductor. The characteristic deriver derives an electrical characteristic of discharge products adhering to the surface on the basis of the oscillating voltage applied to the charging member by the voltage applier and the current value. The process controller determines whether or not to cause the process executor to re-execute the refresh process according to the electrical characteristic when the refresh process is finished.

DETAILED DESCRIPTION

First Embodiment

Figure 1:
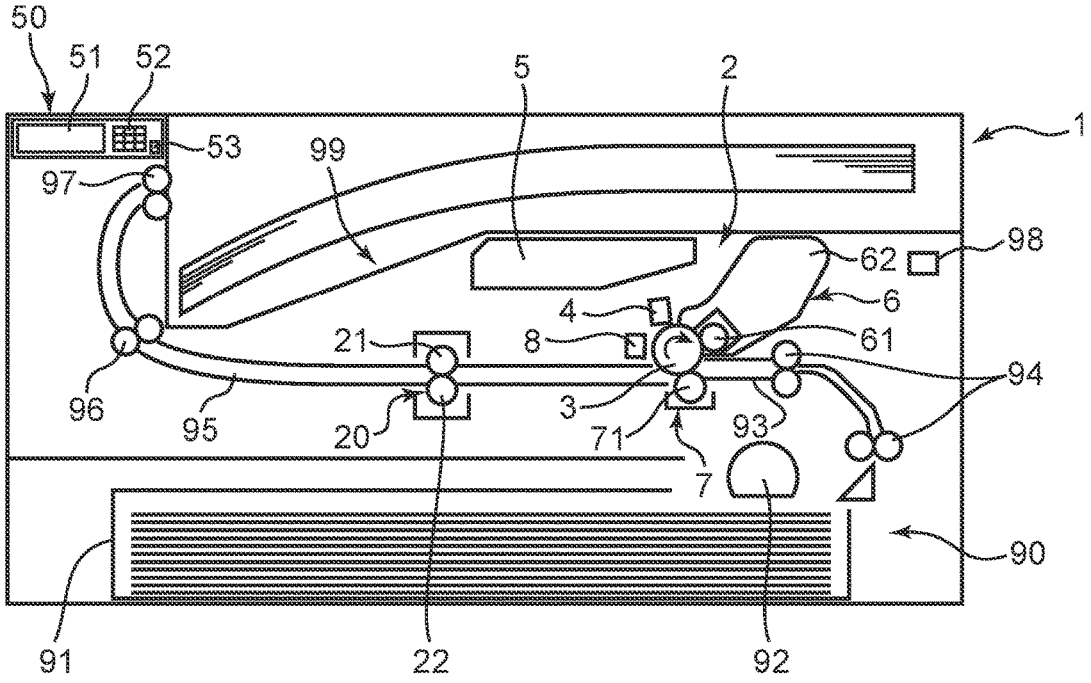
FIG. 1 is a schematic configuration diagram of a printer according to one embodiment of an image forming apparatus of the present disclosure.

Hereinafter, an image forming apparatus according to one embodiment of the present disclosure is described. FIG. 1 is a schematic configuration diagram of a printer 1 according to one embodiment of the image forming apparatus of the present disclosure. As shown in FIG. 1, the printer 1 includes an image forming unit 2, a sheet feeding unit 90, a fixing unit 20, a sheet discharge tray 99, an environment sensor 98 and an operation unit 50.

Figure 2:
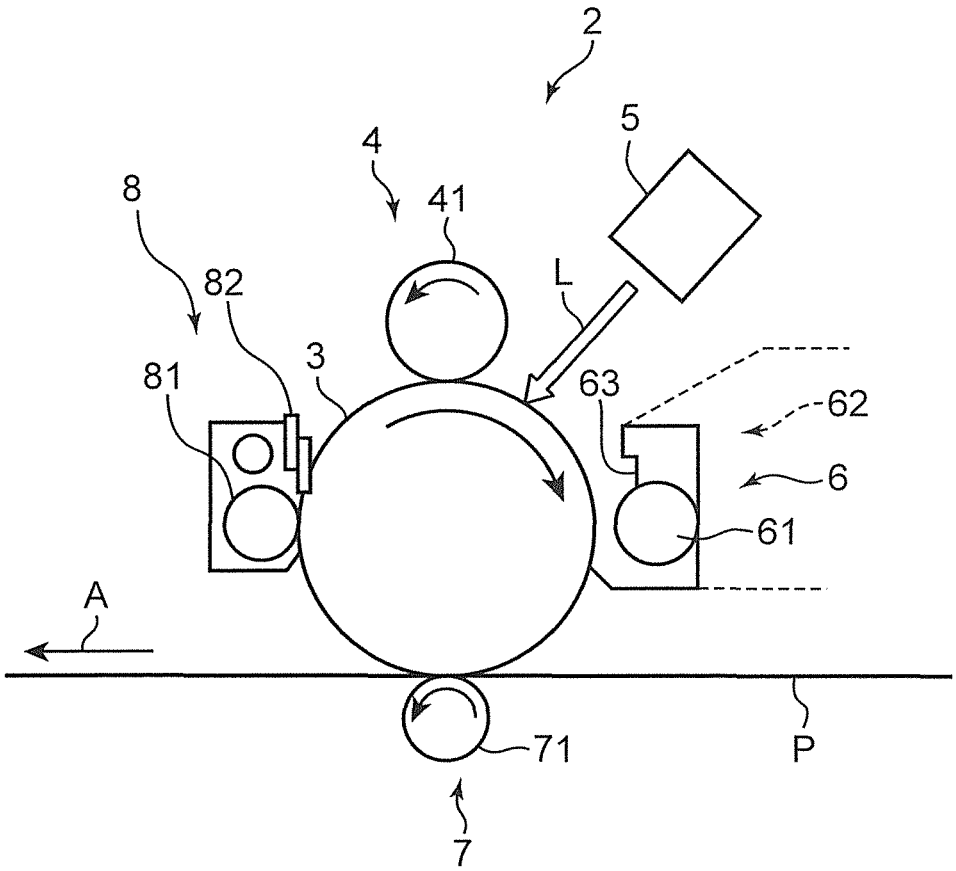
FIG. 2 is a partial enlarged view schematically showing an image forming unit.

The image forming unit 2 forms images on sheets. FIG. 2 is a partial enlarged view schematically showing the image forming unit 2. As shown in FIG. 2, the image forming unit 2 includes a photoconductive drum 3 (photoconductor) and a charging device 4, an exposure device 5, a developing device 6, a transfer device 7 and a cleaning device 8 disposed around the photoconductive drum 3.

The photoconductive drum 3 is a cylindrical body supported rotatably in a predetermined direction (e.g. clockwise direction in FIG. 2). The photoconductive drum 3 includes a photoconductive layer, for example, made of amorphous silicon and having a thickness of ten to several tens of μm. The photoconductive layer forms a surface for carrying electrostatic latent images and toner images corresponding to the electrostatic latent images. Note that the photoconductive layer may be made of selenium arsenic, an organic compound or the like without limitation to amorphous silicon.

The charging device 4 includes a charging roller 41 (charging member) arranged to face in contact with a surface of the photoconductive drum 3. The charging roller 41 imparts electric charges to the photoconductive drum 3 while rotating, following the rotation of the photoconductive drum 3, with a surface thereof held in contact with the surface of the photoconductive drum 3. In this way, the charging device 4 uniformly charges the surface of the photoconductive drum 3 relatively moving with respect to the charging roller 41.

The exposure device 5 includes an unillustrated laser diode for emitting a laser beam. The exposure device 5 irradiates a laser beam L output from the laser diode to the surface of the photoconductive drum 3 uniformly charged by the charging device 4 on the basis of image data stored in a storage unit 140 to be described later. In this way, the exposure device 5 forms electrostatic latent images on the surface of the photoconductive drum 3.

The developing device 6 includes a developing roller 61, a toner storage 62 and a restricting blade 63. The developing roller 61 is arranged to face the photoconductive drum 3 without contacting the photoconductive drum 3. The toner storage 62 stores toner. The restricting blade 63 restricts the amount of toner supplied from the toner storage 62 to the developing roller 61 to a proper amount. The restricting blade 63 restricts a layer thickness of the toner by cutting bristles of the toner adhering in a so-called magnetic brush state to the surface of the developing roller 61. The developing device 6 supplies to the toner adhering to the surface of the developing roller 61 onto the electrostatic latent images formed on the surface of the photoconductive drum 3. In this way, the developing device 6 develops the electrostatic latent images into toner images.

The transfer device 7 includes a transfer roller 71 arranged to face the photoconductive drum 3. The transfer device 7 transfers the toner image developed on the surface of the photoconductive drum 3 onto a sheet P in a state where the sheet P being conveyed in a direction indicated by an arrow A is pressed against the photoconductive drum 3 by the transfer roller 71.

The cleaning device 8 includes a cleaning roller 81 (rubbing member) and a cleaning blade 82 arranged in contact with the surface of the photoconductive drum 3. The cleaning roller 81 is supported rotatably in the same direction as the photoconductive drum 3. The cleaning roller 81 mechanically removes the toner remaining on the surface of the photoconductive drum 3 after the transfer by the transfer device 7 by rotating at a rotation speed faster than the photoconductive drum 3. The cleaning blade 82 mechanically removes the toner remaining on the surface of the photoconductive drum 3 by an end part in contact with the surface of the photoconductive drum 3.

The cleaning roller 81 further rubs the surface of the photoconductive drum 3 for a predetermined time, using toner containing polishing agent supplied to the cleaning roller 81 under a control of a control unit 10 to be described later. In this way, the cleaning roller 81 polishes the surface of the photoconductive drum 3.

Referring back to FIG. 1, the sheet feeding unit 90 includes a sheet cassette 91 for storing sheets, a pickup roller 92 for picking up the stored sheet, a conveyance path 93 constituting a route along which the sheet is conveyed, and conveyor rollers 94 for conveying the sheet in the conveyance path 93. The sheet feeding unit 90 feeds the sheets stored in the sheet cassette 91 one by one by the pickup roller 92. The sheet feeding unit 90 conveys the fed sheet toward a nip portion between the transfer roller 71 and the photoconductive drum 3 by the conveyor rollers 94 and conveys the sheet having a toner image transferred thereto to the fixing unit 20 via a conveyance path 95. The sheet feeding unit 90 discharges the sheet having a fixing process to be described later applied thereto in the fixing unit 20 to the sheet discharge tray 99 by conveyor rollers 96 and discharge rollers 97.

The fixing unit 20 includes a heat roller 21 and a pressure roller 22. The fixing unit 20 fixes the toner image on the sheet by melting the toner on the sheet by heat of the heat roller 21 and applying a pressure by the pressure roller 22.

The environment sensor 98 detects a temperature and a humidity near the image forming unit 2 and outputs a detection signal indicating the detected temperature and humidity to the control unit 10 to be described later.

The operation unit 50 includes a display unit 51 for displaying information, an operation key unit 52 used by a user to give various operational instructions, and a speaker 53. The display unit 51 is, for example, composed of a liquid crystal display having a touch panel function and the like, and displays various pieces of information. The operation key unit 52 includes various keys such as a start key used by the user to input a print instruction and a numeric keypad used to input the number of sets to be printed and the like. The speaker 53 outputs a predetermined sound in accordance with an instruction input from the control unit 10 to be described later.

Figure 3:
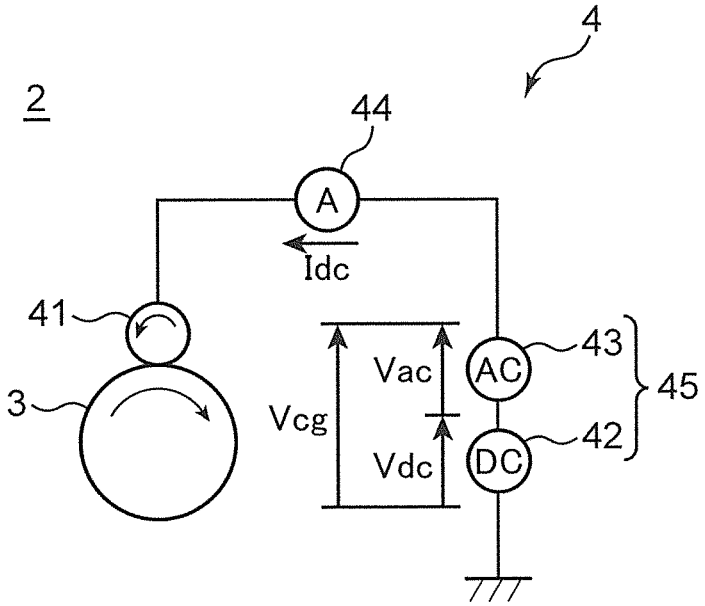
FIG. 3 is a partial enlarged view schematically showing the configuration of a charging device.

Next, the configuration of the charging device 4 is described. FIG. 3 is a partial enlarged view schematically showing the configuration of the charging device 4. As shown in FIG. 3, the charging device 4 includes a charging roller 41, a voltage applier 45 and a current detector 44. The voltage applier 45 includes a direct-current voltage applier 42 and an alternating-current voltage applier 43.

The direct-current voltage applier 42 converts a power supply voltage supplied from an external power supply such as a commercial power supply into a direct-current voltage Vdc having an instructed direct-current voltage value and outputs the direct-current voltage Vdc under a control of the control unit 10 to be described later. The alternating-current voltage applier 43 converts the power supply voltage supplied from the external power supply such as a commercial power supply into an alternating-current voltage Vac having an instructed inter-peak voltage value and outputs the alternating-current voltage Vac under a control of the control unit 10 to be described later. The current detector 44 detects a current value of a charging current (current) Idc flowing from the charging roller 41 to the photoconductive drum 3 and outputs a detection signal indicating a current value of the detected charging current Idc to the control unit 10 to be described later. The current detector 44 is, for example, composed of a current sensor using a Hall element, a shunt resistor and the like.

As shown in FIG. 3, in the charging device 4, a series circuit including the direct-current voltage applier 42 and the alternating-current voltage applier 43 is connected to the charging roller 41 via the current detector 44. Thus, a charging voltage Vcg (oscillating voltage) obtained by superimposing the direct-current voltage Vdc output from the direct-current voltage applier 42 and the alternating-current voltage Vac output from the alternating-current voltage applier 43 is applied to the charging roller 41.

In other words, the voltage applier 45 applies the voltage Vcg obtained by superimposing the direct-current voltage Vdc and the alternating-current voltage Vac to the charging roller 41. The current detector 44 detects the current value of the charging current Idc supplied to the charging roller 41 from the direct-current voltage applier 42 and the alternating-current voltage applier 43, i.e. the current value of the charging current Idc flowing from the charging roller 41 to the photoconductive drum 3 with the charging voltage Vcg applied to the surface of the photoconductive drum 3.

Figure 4:
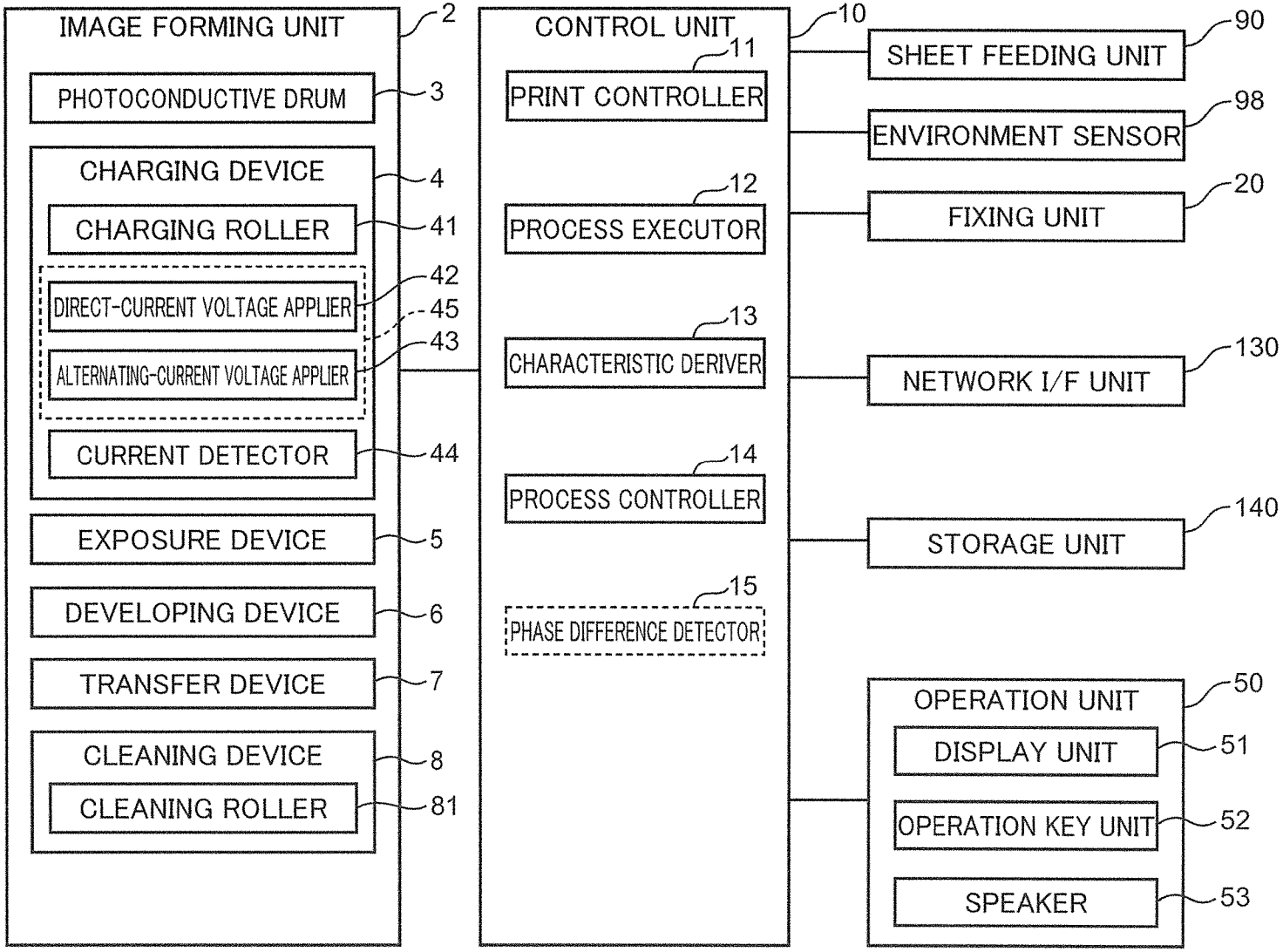
FIG. 4 is a block diagram showing the electrical configuration of the printer.

FIG. 4 is a block diagram showing the electrical configuration of the printer 1. As shown in FIG. 4, the printer 1 includes the image forming unit 2, the sheet feeding unit 90, the environment sensor 98, the fixing unit 20, a network I/F (interface) unit 130, the storage unit 140, the operation unit 50 and the control unit 10.

The network IF unit 130 is connected to a network such as a LAN (Local Area Network). The network IF unit 130 is a communication interface circuit for controlling the transmission and reception of various pieces of data to and from an external device such as a personal computer connected via the network.

The storage unit 140 is a storage device such as a HDD (Hard Disk Drive). Image data transmitted from the external device is stored in the storage unit 140 by the network IF unit 130.

The control unit 10 controls the operation of the entire printer 1. The control unit 10 is, for example, constituted by a microprocessor including a CPU (Central Processing Unit) for performing a predetermined arithmetic processing, a nonvolatile memory such as an EEPROM (Electrically Erasable and Programmable Read Only Memory) storing a predetermined control program, a RAM (Random Access Memory) for temporarily storing data, peripheral circuits of these and the like.

The control unit 10 operates as a print controller 11, a process executor 12, a characteristic deriver 13 and a process controller 14 as indicated by solid-line rectangles of FIG. 4 by executing the control program stored in the above memory or the like.

The printer controller 11 performs a printing process of forming images on sheets. Specifically, in the printing process, the print controller 11 causes the exposure device 5 to form electrostatic latent images on the circumferential surface of the photoconductive drum 3 after the circumferential surface of the photoconductive drum 3 is charged by the charging device 4. After causing the developing device 6 to develop the electrostatic latent images formed on the circumferential surface of the photoconductive drum 3 as toner images, the print controller 11 causes the transfer device 7 to transfer the toner images to sheets. The print controller 11 causes the fixing unit 20 to fix the transferred toner images to the sheets. In this way, the images are formed on the sheets.

Further, the print controller 11 causes the sheet feeding unit 90 to discharge the sheet having the image formed thereon by the printing process. Further, the print controller 11 causes the toner remaining on the photoconductive drum 3 to be removed by rotating the cleaning roller 81 at a rotation speed faster than the photoconductive drum 3 during the execution of the printing process.

The process executor 12 executes a refresh process at a predetermined timing. The refresh process is a process of rubbing the surface of the photoconductive drum 3 against the cleaning roller 81 for a predetermined time (e.g. 60 sec) by supplying a predetermined amount of the toner to the cleaning roller 81 while rotating the cleaning roller 81 at a rotation speed (e.g. 266×1.2 mm/sec) faster than a rotation speed (e.g. 266 mm/sec) of the photoconductive drum 3.

In the refresh process, the amount of the toner supplied to the cleaning roller 81 is, for example, determined as the amount of the toner supplied when a toner image is formed in an area of 94 mm in a rotating direction of the surface of the photoconductive drum 3. Note that this toner amount may be appropriately adjusted according to the temperature and humidity near the image forming unit 2 indicated by the detection signal output by the environment sensor 98.

An execution timing of the refresh process by the process executor 12 is, for example, determined as a timing when the printer 1 is turned on or returns from a sleep state when the humidity near the image forming unit 2 indicated by the detection signal output by the environment sensor 98 (hereinafter, detected humidity) is within a predetermined high humidity range (e.g. 60% or higher and below 70%).

Note that the high humidity range may be classified into a plurality of ranges such as a range of 60% or higher and below 70%, a range of 70% or higher and below 80% and a range of 80% or higher. Further, for each classified range, the number of times of execution of the refresh process may be determined to be larger as the humidity indicated by the range becomes higher. For example, it may be determined that the refresh process is executed twice if the detected humidity is in the high humidity range of 60% or higher and below 70% and four times if the detected humidity is in the high humidity range of 70% or higher and below 80%. Furthermore, similarly to this, it may be determined for each classified range, a larger amount of the toner is supplied to the cleaning roller 81 in the refresh process as the humidity indicated by this range becomes higher.

The characteristic deriver 13 derives an electrical characteristic of discharge products such as nitrate ions and ammonium ions adhering to the surface of the photoconductive drum 3 by discharge from the charging roller 41 on the basis of the charging voltage Vcg applied to the charging roller 41 by the voltage applier 45 and the current value of the charging current Idc detected by the current detector 44.

Figure 5:
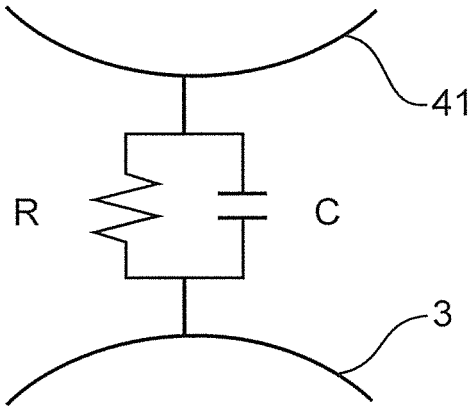
FIG. 5 is an equivalent circuit diagram of discharge products adhering to a surface of a photoconductive drum.
Figure 6:
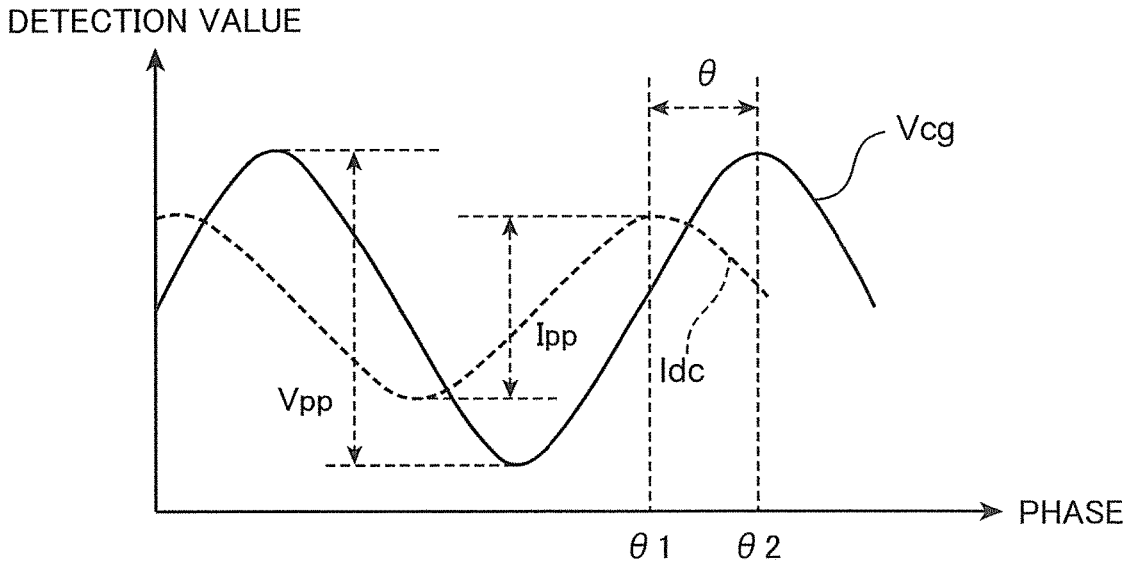
FIG. 6 is a graph showing the waveforms of a charging voltage and a charging current.

FIG. 5 is an equivalent circuit diagram of discharge products adhering to the surface of the photoconductive drum 3. FIG. 6 is a graph showing the waveforms of the charging voltage Vcg and the charging current Idc. Specifically, the characteristic deriver 13 regards the adhesion of the discharge products to the surface of the photoconductive drum 3 as the insertion of a parallel circuit composed of a resistor having a resistance value R and a condenser or capacitor having a capacitance C between the surface of the photoconductive drum 3 and the charging roller 41 as shown in FIG. 5.

The characteristic deriver 13 causes the direct-current voltage applier 42 to output a direct-current voltage Vdc having a predetermined direct-current voltage value and causes the alternating-current voltage applier 43 to output an alternating-current voltage Vac having a predetermined inter-peak voltage value Vpp. In this way, the characteristic deriver 13 causes the voltage applier 45 to apply a charging voltage Vcg obtained by superimposing the direct-current voltage Vdc and the alternating-current voltage Vac to the charging roller 41. Note that the predetermined direct-current voltage value and the predetermined inter-peak voltage value Vpp are, for example, determined to be voltage values of several tens of V to prevent discharge from the charging roller 41 when the charging voltage Vcg obtained by superimposing the direct-current voltage Vdc having the direct-current voltage value and the alternating-current voltage Vac having the inter-peak voltage value Vpp is applied to the charging roller 41.

The characteristic deriver 13 derives an impedance Z of the parallel circuit as the electrical characteristic of the discharge products adhering to the surface of the photoconductive drum 3 as shown in FIG. 6, using the following equation (1) including the inter-peak voltage value Vpp of the alternating-current voltage Vac included in the charging voltage Vcg and an inter-peak current value Ipp of the charging current Idc detected by the current detector 44. Note that the characteristic deriver 13 may be constituted by ASIC (Application Specific Integrated Circuits).

[Equation 1]

$$Z = \frac{|Vpp|}{|Ipp|} \quad (1)$$

The process controller 14 determines whether or not to cause the process executor 12 to re-execute the refresh process according to the electrical characteristic of the discharge products derived by the characteristic deriver 13 when the refresh process by the process executor 12 is finished.

Figure 7:
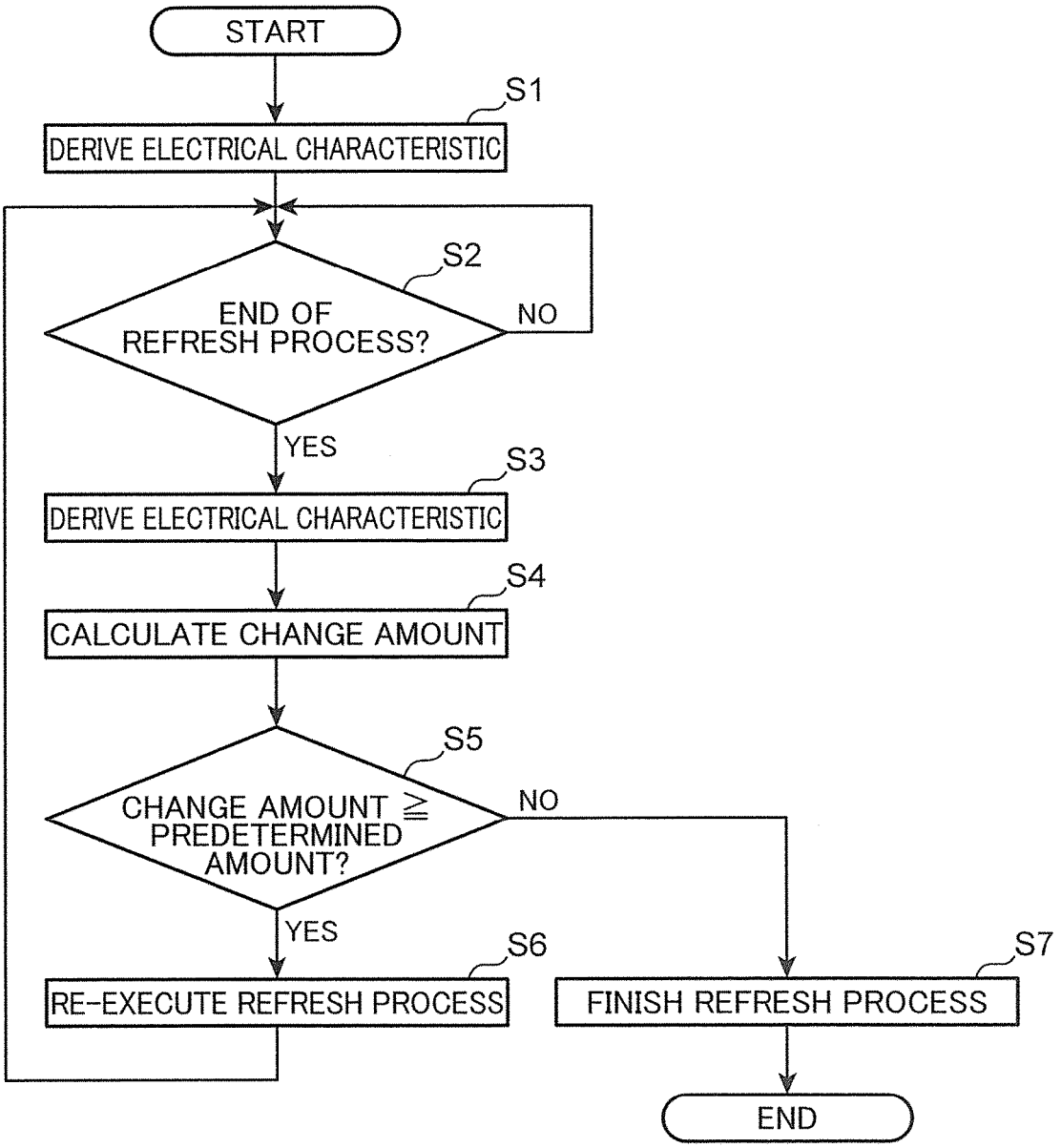
FIG. 7 is a flow chart showing a control operation of a refresh process.

FIG. 7 is a flow chart showing a control operation of the refresh process. Specifically, when the process executor 12 starts the refresh process, the process controller 14 starts a control of the refresh process. As shown in FIG. 7, the process controller 14 causes the characteristic deriver 13 to derive the electrical characteristic of the discharge products (Step S1) when starting the control of the refresh process.

Thereafter, the process controller 14 waits while the refresh process is executed by the process executor 12 (Step S2; NO). When a predetermined time elapses from the start of the refresh process and the refresh process is finished (Step S2; YES), the process controller 14 causes the characteristic deriver 13 to derive the electrical characteristic of the discharge products as in Step S1 (Step S3).

The process controller 14 calculates a change amount of the electrical characteristic derived by the characteristic deriver 13 in Step S3 this time from the electrical characteristic derived by the characteristic deriver 13 in Step S1 or Step S3 last time (=|electrical characteristic derived by the characteristic deriver 13 this time−electrical characteristic derived by the characteristic deriver 13 last time|) as a change amount of the electrical characteristic of the discharge products (Step S4).

The process controller 14 causes the process executor 12 to re-execute the refresh process (Step S6) if the change amount calculated in Step S4 is equal to or more than a predetermined amount (Step S5; YES). Thereafter, processings in Step S2 and subsequent Steps are performed. That is, the process controller 14 causes the characteristic deriver 13 to derive the electrical characteristic of the discharge products (Step S3) when the re-executed refresh process is finished (Step S2; YES) in the case of causing the process executor 12 to re-execute the refresh process. Then, the process controller 14 calculates a change amount of the electrical characteristic of the discharge products derived by the characteristic deriver 13 in Step S3 this time from the electrical characteristic of the discharge products derived by the characteristic deriver 13 in Step S3 when the last refresh process was finished as the change amount (Step S4). Thereafter, processings in Step S5 and subsequent Steps are performed.

On the other hand, if the change amount calculated in Step S4 is less than the predetermined amount (Step S5; NO), the process controller 14 causes the process executor 12 to finish the refresh process without re-executing the refresh process (Step S7). In this way, the process controller 14 finishes the control operation of the refresh process.

Figure 8:
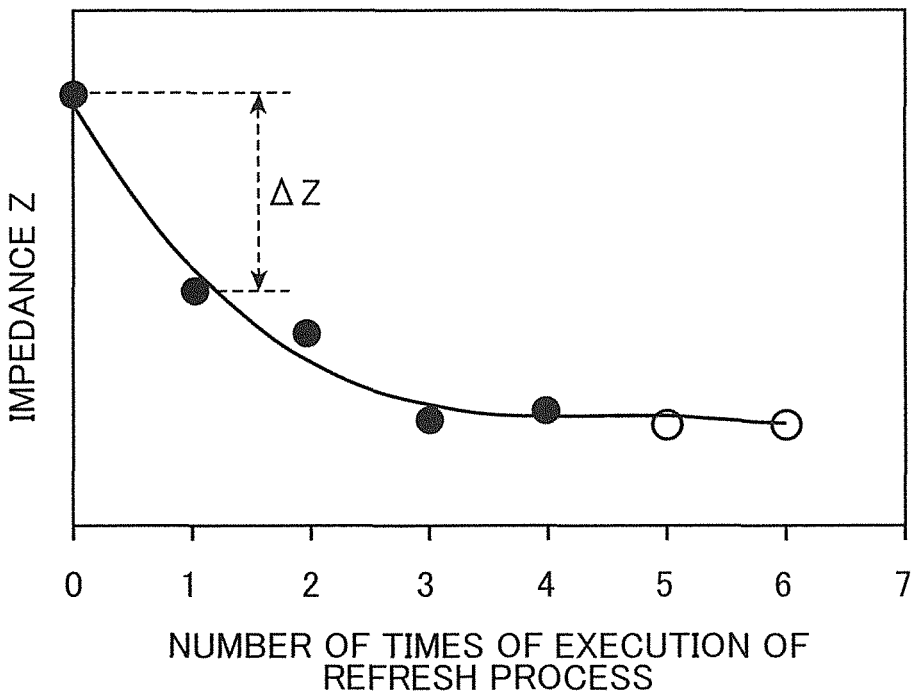
FIG. 8 is a graph showing an example of a relationship between the number of times of execution of the refresh process and an impedance of the discharge products.

A specific example is described below in which the process executor 12 starts the refresh process and the process controller 14 executes the control of the refresh process shown in FIG. 7 when the detected humidity is within the high humidity range for which it is determined that the refresh process is executed six times. FIG. 8 is a graph showing an example of a relationship between the number of times of execution of the refresh process and the impedance Z of the discharge products in this specific example.

A horizontal axis of FIG. 8 represents the number of times of execution of the refresh process, and a vertical axis of FIG. 8 represents the impedance Z of the discharge products derived by the characteristic deriver 13. Black circles of FIG. 8 show a relationship of the number of times of execution of the refresh process and the impedance Z derived by the characteristic deriver 13 in Steps S1 and S3 when the refresh process was executed four times. White circles of FIG. 8 show a relationship of the number of times of execution of the refresh process and the impedance Z derived by the characteristic deriver 13 when the refresh process was executed six times without causing the process controller 14 to execute the control of the refresh process shown in FIG. 7. A curve of FIG. 8 is an approximation curve representing a relationship of the number of times of execution of the refresh process and the impedance Z derived by the characteristic deriver 13 derived on the basis of the relationships indicated by the black and white circles.

That is, in this specific example, the process controller 14 causes the process executor 12 to re-execute the refresh process by executing the control of the refresh process shown in FIG. 7 since a change amount ΔZ calculated when the first refresh process was finished is equal to or more than the predetermined amount. Similarly, the process controller 14 causes the process controller 12 to re-execute the refresh process since the change amounts ΔZ calculated when the second and third refresh processes were finished are equal to or more than the predetermined amount. Thereafter, the process controller 14 causes the process executor 12 to finish the refresh process without re-executing the refresh process since the change amount ΔZ calculated when the fourth refresh process was finished is less than the predetermined amount.

As just described, in this specific example, the process controller 14 does not cause the process executor 12 to re-execute the refresh process, assuming that the discharge products could be no longer substantially removed from the surface of the photoconductive drum 3 by the refresh process when the change amount of the impedance Z of the discharge products becomes less than the predetermined amount due to the execution of the refresh process four times. Thus, the refresh process can be properly finished. In this way, it can be avoided that the process executor 12 unnecessarily executes the fifth and sixth refresh processes although the discharge products cannot be substantially removed.

As described above, according to the configuration of the first embodiment, the impedance Z of the discharge products adhering to the surface of the photoconductive drum 3 is derived on the basis of the charging voltage Vcg applied to the charging roller 41 by the voltage applier 45 and the current value of the charging current Idc detected by the current detector 44 when the refresh process is finished. Whether or not to re-execute the refresh process is determined according to the derived impedance Z. Thus, the amount of the adhering discharge products corresponding to a degree of wear deterioration of the photoconductive drum 3 can be grasped as the impedance Z of the discharge products. The refresh process can be executed an appropriate number of times according to the grasped impedance Z. In this way, the discharge products adhering to the surface of the photoconductive drum 3 can be properly removed.

If the change amount ΔZ of the impedance Z of the discharge products is equal to or more than the predetermined amount, it is thought that a given amount of the discharge products adhering to the surface of the photoconductive drum 3 were removed by the refresh process and a change was seen in the electrical characteristic of the discharge products. According to the configuration of the first embodiment, the refresh process is re-executed in this case. Thus, the discharge products adhering to the surface of the photoconductive drum 3 can be further removed by the re-executed refresh process.

On the other hand, if the change amount ΔZ becomes less than the predetermined amount, it is thought that the discharge products adhering to the surface of the photoconductive drum 3 had been already sufficiently removed by the refresh process and no change was seen in the electrical characteristic of the discharge products. According to the configuration of the first embodiment, the refresh process is finished in this case. Thus, the refresh process can be properly finished by avoiding the unnecessary re-execution of the refresh process.

Second Embodiment

Next, an image forming apparatus according to a second embodiment of the present disclosure is described. Note that, in the following description, the same constituent elements as in the first embodiment are denoted by the same reference signs as in the first embodiment and are not described. The second embodiment differs from the first embodiment in that a control unit 10 operates further as a phase difference detector 15 by executing the control program stored in the above memory or the like as indicated by a broken line rectangle of FIG. 4.

The phase difference detector 15 detects a phase difference between a charging voltage Vcg applied to a charging roller 41 by a voltage applier 45 and a charging current Idc flowing from the charging roller 41 to a photoconductive drum 3. Specifically, the phase difference detector 15 detects a phase difference θ between a phase θ1 when a current value of the charging current Idc flowing from the charging roller 41 to the photoconductive drum 3 and detected by a current detector 44 is largest (peak value) and a phase θ2 when a voltage value of the charging voltage Vcg applied to the charging roller 41 by the voltage applier 45 is largest (peak value). Note that the phase difference detector 15 may be constituted by ASIC (Application Specific Integrated Circuits).

Further, the second embodiment differs from the first embodiment in that a characteristic deriver 13 derives a resistance value of discharge products as an electrical characteristic of the discharge products on the basis of the phase difference θ detected by the phase difference detector 15.

Specifically, the characteristic deriver 13 regards the adhesion of the discharge products to the surface of the photoconductive drum 3 as the insertion of a parallel circuit composed of a resistor having a resistance value R and a condenser or capacitor having a capacitance C between the surface of the photoconductive drum 3 and the charging roller 41 as shown in FIG. 5 as in the first embodiment. The characteristic deriver 13 causes the voltage applier 45 to apply a charging voltage Vcg obtained by superimposing a direct-current voltage Vdc having a predetermined direct-current voltage value and an alternating-current voltage Vac having a predetermined inter-peak voltage value Vpp to the charging roller 41 as in the first embodiment. Then, the characteristic deriver 13 derives an impedance Z of the parallel circuit, using the above equation (1) using the inter-peak voltage value Vpp of the alternating-current voltage Vac included in the charging voltage Vcg and an inter-peak current value Ipp of the charging current Idc detected by the current detector 44.

In the second embodiment, the characteristic deriver 13 further derives the resistance value R of the resistor of the parallel circuit as an electrical characteristic of the discharge products adhering to the surface of the photoconductive drum 3, using the following three known relational equations (2) to (4) concerning an RC parallel circuit using the calculated impedance Z of the parallel circuit and the phase difference θ detected by the phase difference detector 15. Note that, in the equations (2) to (4), ω denotes an angular frequency (=2π×frequency) of the alternating-current voltage Vac included in the charging voltage Vcg, and j denotes an imaginary unit.

[Equation 2]

$$Z = \frac{R}{1 + j\omega RC} \tag{2}$$

$$Z\cos\theta = \frac{R}{1 + j\omega^2 R^2 C^2} \tag{3}$$

$$Z\sin\theta = \frac{\omega R^2 C}{1 + j\omega^2 R^2 C^2} \tag{4}$$

In accordance with this, the process controller 14 determines whether or not to cause the process executor 12 to re-execute the refresh process according to the resistance value R of the discharge products derived by the characteristic deriver 13 as in the first embodiment.

Specifically, the process controller 14 causes the characteristic deriver 13 to derive the resistance value R of the discharge products as the electrical characteristic of the discharge products in Steps S1 and S3. Further, in Step S4, the process controller 14 calculates a change amount of the resistance value R derived by the characteristic deriver 13 in Step S3 this time from the resistance value R derived by the characteristic deriver 13 in Step 1 or Step S3 last time (=|resistance value R derived by the characteristic deriver 13 this time−resistance value R derived by the characteristic deriver 13 last time|) as the change amount of the electrical characteristic of the discharge products.

Then, the process controller 14 causes the process executor 12 to re-execute the refresh process (Step S6) by performing processings in Step S5 and subsequent Steps if the change amount of the resistance value R derived by the characteristic deriver 13 is equal to or more than a predetermined amount (Step S5; YES). On the other hand, if the change amount becomes less than the predetermined amount (Step S5; NO), the process controller 14 causes the process executor 12 to finish the refresh process without re-executing the refresh process (Step S7).

According to the configuration of the second embodiment, the resistance value R of the discharge products is derived on the basis of the charging voltage Vcg applied to the charging roller 41 by the voltage applier 45, the current value of the charging current Idc detected by the current detector 44 and the phase difference θ detected by the phase difference detector 15 when the refresh process is finished. Then, whether the refresh process is re-executed or the refresh process is finished without being re-executed is determined according to the derived resistance value R of the discharge products. Thus, the amount of the adhering discharge products corresponding to a degree of wear deterioration of the photoconductive drum 3 can be grasped as the resistance value R of the discharge products. Then, the refresh process can be executed an appropriate number of times according to the grasped resistance value R.

Third Embodiment

Next, an image forming apparatus according to a third embodiment of the present disclosure is described. Note that, in the following description, the same constituent elements as in the second embodiment are denoted by the same reference signs as in the second embodiment and are not described. The third embodiment differs from the second embodiment in that a characteristic deriver 13 derives a capacitance of discharge products as an electrical characteristic of the discharge products.

Specifically, the characteristic deriver 13 causes a voltage applier 45 to apply a charging voltage Vcg obtained by superimposing a direct-current voltage Vdc having a predetermined direct-current voltage value and an alternating-current voltage Vac having a predetermined inter-peak voltage value Vpp to a charging roller 41 as in the second embodiment. Then, the characteristic deriver 13 calculates an impedance Z of the above parallel circuit (FIG. 5), using the above equation (1) using an inter-peak voltage value Vpp of the alternating-current voltage Vac included in the charging voltage Vcg and an inter-peak current value Ipp of the charging current Idc detected by a current detector 44. Further, the characteristic deriver 13 derives a capacitance C of the condenser or capacitor of the parallel circuit as an electrical characteristic of the discharge products adhering to the surface of the photoconductive drum 3, using the aforementioned three known relational expressions (2) to (4) concerning an RC parallel circuit using the calculated impedance Z of the parallel circuit and a phase difference θ detected by a phase difference detector 15.

In accordance with this, the process controller 14 determines whether or not to cause the process executor 12 to re-execute the refresh process according to the capacitance C of the discharge products derived by the characteristic deriver 13 as in the second embodiment.

Specifically, the process controller 14 causes the characteristic deriver 13 to derive the capacitance C of the discharge products as the electrical characteristic of the discharge products in Steps S1 and S3. Further, in Step S4, the process controller 14 calculates a change amount of the capacitance C derived by the characteristic deriver 13 in Step S3 this time from the capacitance C derived by the characteristic deriver 13 in Step 1 or Step S3 last time (=|capacitance C derived by the characteristic deriver 13 this time−capacitance C derived by the characteristic deriver 13 last time|) as the change amount of the electrical characteristic of the discharge products.

Then, the process controller 14 causes the process executor 12 to re-execute the refresh process (Step S6) by performing processings in Step S5 and subsequent Steps if the change amount of the capacitance C derived by the characteristic deriver 13 is equal to or more than a predetermined amount (Step S5; YES). On the other hand, if the change amount becomes less than the predetermined amount (Step S5; NO), the process controller 14 causes the process executor 12 to finish the refresh process without re-executing the refresh process (Step S7).

According to the configuration of the third embodiment, the capacitance C of the discharge products is derived on the basis of the charging voltage Vcg applied to the charging roller 41 by the voltage applier 45, the current value of the charging current Idc detected by the current detector 44 and the phase difference θ detected by the phase difference detector 15 when the refresh process is finished. Then, whether the refresh process is re-executed or the refresh process is finished without being re-executed is determined according to the derived capacitance C of the discharge products. Thus, the amount of the adhering discharge products corresponding to a degree of wear deterioration of the photoconductive drum 3 can be grasped as the capacitance C of the discharge products. Then, the refresh process can be executed an appropriate number of times according to the grasped capacitance C.

Note that the above first to third embodiments are mere illustration of the embodiment according to the present disclosure and not intended to limit the present disclosure to the above embodiments. For example, the present disclosure may be modified as follows.

(1) In the above first to third embodiments, the image forming apparatus according to the one embodiment of the present disclosure is an image forming apparatus of a monochrome printing type for forming images on sheets using one image forming unit 2. However, without limitation to this, the image forming apparatus according to the present disclosure may be an image forming apparatus of a color printing type for forming multicolor images on sheets by including a plurality of image forming units similar to the image forming unit 2. In this case, the process executor 12, the characteristic deriver 13, the process controller 14 and the phase difference detector 15 may operate as described in the above first to third embodiments for each of the plurality of image forming units.

(2) In the above first to third embodiments, the process controller 14 causes the characteristic deriver 13 to derive the impedance Z of the discharge products in Step S3 at the end of the refresh process after the elapse of the predetermined time from the start of the refresh process in Step S3. Then, in Step S4, the change amount of the impedance Z derived by the characteristic deriver 13 this time from the impedance Z derived by the characteristic deriver 13 last time is calculated as the change amount ΔZ of the electrical characteristic of the discharge products.

However, instead of this, the process controller 14 may cause the characteristic deriver 13 to regularly derive the impedance Z of the discharge products during the execution of the refresh process. According to this, the process controller 14 may regularly calculate the change amount of the impedance Z derived by the characteristic deriver 13 this time from the impedance Z derived by the characteristic deriver 13 last time as the change amount ΔZ.

In this case, the process controller 14 may cause the refresh process to be forcibly finished when the change amount ΔZ becomes less than the predetermined amount during the execution of the refresh process. Alternatively, if the change amount ΔZ becomes less than the predetermined amount during the execution of the refresh process, the process controller 14 may cause the process executor 12 to finish the refresh process at the end of the refresh process after the elapse of the predetermined time from the start of the refresh process being executed. In this case, the process controller 14 may cause the process executor 12 to re-execute the refresh process when the change amount ΔZ is more than the predetermined amount at the end of the refresh process.

According to the present disclosure as described above, discharge products adhering to a surface of a photoconductive drum can be properly removed.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. An image forming apparatus, comprising:

a photoconductor including a photoconductive layer forming a surface for carrying an electrostatic latent image;

a charging member arranged in contact with or in proximity to the surface;

a voltage applier for charging the surface by applying an oscillating voltage obtained by superimposing a direct-current voltage and an alternating-current voltage to the charging member;

a rubbing member arranged in contact with the surface to rub the surface;

a process executor for executing a refresh process of causing the rubbing member to rub the surface for a predetermined time by supplying toner to the rubbing member;

a current detector for detecting a current value of a current flowing from the charging member to the photoconductor;

a characteristic deriver for deriving an electrical characteristic of discharge products adhering to the surface on the basis of the oscillating voltage applied to the charging member by the voltage applier and the current value; and a process controller for determining whether or not to cause the process executor to re-execute the refresh process according to the electrical characteristic when the refresh process is finished.

2. An image forming apparatus according to claim 1, wherein:

the process controller causes the process executor to re-execute the refresh process if a change amount of the electrical characteristic derived by the characteristic deriver is equal to or more than a predetermined amount and causes the process executor to finish the refresh process if the change amount is less than the predetermined amount.

3. An image forming apparatus according to claim 1, wherein:

the electrical characteristic is an impedance.

4. An image forming apparatus according to claim 1, further comprising:

a phase difference detector for detecting a phase difference between the oscillating voltage and the current, wherein:

the characteristic deriver further derives a resistance value of the discharge products as the electrical characteristic on the basis of the phase difference.

5. An image forming apparatus according to claim 1, further comprising:

a phase difference detector for detecting a phase difference between the oscillating voltage and the current, wherein:

the characteristic deriver further derives a capacitance of the discharge products as the electrical characteristic on the basis of the phase difference.

6. An image forming apparatus according to claim 1, wherein:

the photoconductive layer is made of amorphous silicon.

* * * * *